US006484899B1

(12) United States Patent
Garton

(10) Patent No.: US 6,484,899 B1
(45) Date of Patent: Nov. 26, 2002

(54) FLUID TANK ASSEMBLY

(75) Inventor: Darwin Garton, Lincoln, NE (US)

(73) Assignee: Snyder Industries, Inc.

( * ) Notice: Subject to any disclaimer, the term of this patent is extended or adjusted under 35 U.S.C. 154(b) by 19 days.

(21) Appl. No.: 09/703,218

(22) Filed: Oct. 31, 2000

(51) Int. Cl.[7] ..... B65D 25/24
(52) U.S. Cl. ..... 220/630; 220/565; 220/636
(58) Field of Search ..... 206/511, 512; 220/565, 562, 630, 628, 636, 606, 605, 567

(56) References Cited

U.S. PATENT DOCUMENTS

| | | | | |
|---|---|---|---|---|
| 2,332,410 A | * | 10/1943 | Strothman | 206/512 |
| 3,407,961 A | * | 10/1968 | Box | 206/511 |
| 4,214,670 A | * | 7/1980 | Berger et al. | 220/606 |
| 4,887,731 A | * | 12/1989 | Pett et al. | 220/630 |
| 4,961,509 A | * | 10/1990 | Currier | 220/630 |
| 4,989,741 A | * | 2/1991 | Dull et al. | 206/512 |
| 5,197,601 A | * | 3/1993 | Sterett | 206/511 |
| 5,361,930 A | * | 11/1994 | Perry | 220/565 |
| 5,374,026 A | | 12/1994 | Spurrier et al. | |
| 5,430,927 A | | 7/1995 | Rogers | |
| 5,490,603 A | | 2/1996 | Davis | |
| 5,544,777 A | | 8/1996 | Watson | |
| 6,079,580 A | | 6/2000 | Garton et al. | |

OTHER PUBLICATIONS

Color brochure for Transpak 120 Mini–Bulk Container (2 pages) from Snyder Industries, Inc.
Color Brochure for Snyder AG Chem Tanks (4 pages) from Snyder Industries, Inc.

* cited by examiner

*Primary Examiner*—Stephen Castellano
(74) *Attorney, Agent, or Firm*—Hovey Williams LLP

(57) ABSTRACT

A fluid storage tank assembly is provided which includes a tank having sidewalls, a bottom wall and a top wall, and a support columns positioned between the sidewalls. The support columns blend into the sidewalls to avoid sharp corners and the sidewalls join with the bottom wall and the top wall along rounded edges to avoid stress concentrations in the tank. The tank is rotationally molded of synthetic resin, and is provided with a plurality of detachably mounted discrete legs which thread into recesses in the bottom wall. The top wall includes an indentation, and the indentation and the reception surfaces atop the support columns receive the legs of a second fluid storage tank stacked thereon. A bottom protector provided as a relatively thin sheet of synthetic resin material has a plurality of holes therethrough to permit insertion of the threaded shanks of the legs to pass therethrough for coupling the protector to the bottom of the tank.

28 Claims, 4 Drawing Sheets

FLUID TANK ASSEMBLY

BACKGROUND OF THE INVENTION

1. Field of the Invention

This invention concerns a fluid tank assembly capable of containing intermediate volumes of liquid in stacking relationship without additional reinforcement. More particularly, it is concerned with a tank which is rotationally molded of synthetic resin and wherein the walls of the tank are configured with corners including generally upright arcuate support portions to substantially retain the shape of the tank when filled, lifted from the bottom and/or stacked with similar tanks. The fluid tank assembly also has independent and removable support legs which facilitate stacking and retain a web-like bottom wall protector.

2. Description of the Prior Art

Various types of industrial liquids, including hazardous chemicals, are transported and stored in tanks and containers of a variety of sizes. These tanks have increasingly been manufactured of polyethylene or other synthetic resins for corrosion resistance, weight, and other reasons. These tanks have a storage capacity typically of from about 15 U.S. gallons to 793 U.S. gallons, and are often set on bases for lifting with a forklift. These bases underlie substantially the entire tank and may be complementally configured with the top of the tank as well as the bottom so that similar tanks and bases may be stacked one atop the other in the warehouse. Usually, such bases are separately attachable to the tank which contains the liquid.

Typically, these tanks have a specially designed shape and are formed with walls having a strong, rigid construction so that when several of the filled containers are stacked one on another, the container on the bottom of the stack has the load bearing capacity to support the total weight of the filled containers on top of it. Other types of containers have bases with stacking legs which surround the tank and extend above it, thereby protecting the tank and avoiding load transference through the walls of the tank. Among the tanks useful for transporting and storing industrial liquids are those shown in U.S. Pat. Nos. 5,490,603 and 6,079,580, both assigned to the assignee of the present invention.

Notwithstanding many beneficial features of these tanks, there remain several drawbacks. Tanks without stacking legs usually still require elaborate and expensive bases for stacking and dispensing liquid from the bottom outlet thereof, as well as to stabilize the tank and enable the tank to be lifted by a forklift. Moreover, in order to sustain the weight of filled tanks stacked thereon, the walls of the tank portion must be relatively thick and undamaged. Those fluid transportation and storage tanks having frames or stacking legs extending upwardly from their bases present significant advantages in terms of weight transfer, but are expensive to manufacture and may require the molding of three separate parts—the base and stacking legs, the tank, and the top protector.

Thus, there has developed a real need for an improved tank capable of handling industrial liquids, having good stacking characteristics with greater economy of manufacture. There is a further need for a tank having improvements in construction to maintain economy and still resist damage from fork lift tines and pallet jacks. There is additionally a need for improvements in the manner of elevating the bottom of the tank above a floor or other supporting surface.

SUMMARY OF THE INVENTION

These and other needs have largely been met by the fluid storage tank assembly of the present invention. That is to say, the invention hereof provides capabilities of storing intermediate amounts of liquid in a tank which is both self supporting and stackable when filled, and wherein the tank has very little deflection or dimensional difference between a filled and unfilled configuration. Furthermore, the tank avoids the need for a large base by employing legs which support the tank. The legs advantageously are removably mounted to the bottom wall of the tank, and retain an optional bottom protector in place in the manner of fasteners so that the protector acts as a shield between the bottom wall of the tank and pallet jacks or fork lift tines.

In greater detail, the assembly of the invention most preferably includes a tank and a plurality of removable support legs, and may also include a bottom protector of a relatively thin web of material which is held in position adjacent a bottom wall of the tank by the legs. The side walls of the tank are substantially curvilinear, with the tank including integrally molded support columns at its corners, whereby the tank presents a generally polygonal shape in horizontal cross-section. The support columns are integral with the side walls, receive liquid therein and thus, together with the side walls, top wall and bottom wall define the liquid receiving chamber. The preferred side walls are curvilinear rather than lying in flat, upright planes, and thus are somewhat arcuate either in vertical section, horizontal section, or possibly both vertical and horizontal section and merge into rounded corners along at least the top edge. The support columns are generally curved in horizontal section and may be generally of oppositely extending frustoconical portions or generally cylindrical in configuration. The support columns receive fluid therein and need not extend in a full circular in horizontal section but only a segment thereof, as the support columns are hollow to receive liquid as a part of the chamber formed by the support columns and the walls of the tank. The bottom wall preferably includes an integrally formed diagonally extending reinforcing channel extending from the center toward the support columns at the corner, with the top wall preferably similarly configured. The bottom wall adjacent the reinforcing channel is preferably somewhat arcuate whereby the reinforcing channel acts as a bottom support beam with the arcuate bottom wall to transfer the weight of the liquid carried within the tank to the support columns and to distribute the load to the vertical walls. The bottom deck of each of the ribs forming the reinforcing channel is substantially co-planar to provide an even engagement surface for facilitating lifting of the tank assembly by a fork lift or pallet jack. While the portions of the reinforcing channel atop the support columns are preferably flat and stepped downwardly relative to the top deck of the ribs of the reinforcing channel by an adjacent arcuate margin to provide reception surfaces for legs of a similar tank assembly stacked thereon, the reinforcing channel at the bottom of the support columns is preferably provided with internally threaded recesses to receive a threaded shank on the feet. In addition, the intersection of the diagonally extending ribs of the reinforcing channel is preferably indented in the top wall and a recess is threaded in the bottom wall to permit attachment of a leg thereto. The bottom wall of the tank is preferably provided with an outlet threaded to receive a pipe or valve thereon, while the top wall may include a threaded collar to receive a cap and a threaded internal neck for mounting of a bung. The tank is preferably made by rotational molding of polyethylene or other suitable synthetic resin.

The legs are also molded of polyethylene or other synthetic resin, either by blow molding, rotational molding or injection molding. The legs are provided with a shoulder for retaining the bottom protector in position and a threaded shank sized and threaded complementally to the recesses in the bottom wall of the tank.

The optional bottom protector is configured for positioning beneath the bottom wall of the tank and includes openings therein sized to receive the shanks of the but abut the shoulders of the legs. The bottom protector is a relatively thin web or sheet of material which helps avoid damage to the bottom wall and distribute force from the fork lift tines to the reinforcing channel. Thus, the legs serve the dual purpose of elevating the tank above the floor and holding the bottom protector in position.

In use, a plurality of tanks may be stacked one atop the other, even when filled. The bottom surface of the legs of the upper tank assembly rest on and are held in position by the margins or rims on the diagonally extending reinforcing channel in the top wall. Because each of the support columns and the center indentation in the reinforcing channel are recessed below the channel and face outwardly from the center, the upper tank may be readily lifted off the lower tank but resists lateral movement relative thereto. The arcuate configuration of the sidewalls and the integrated support columns cooperate to bear the load of the tank as well as assemblies positioned thereon. Pallet jacks or fork lift tines are provided ready access because the legs elevate the bottom wall and the bottom protector above the floor, and the bottom protector, which may be readily replaced, helps to isolate the bottom wall of the tank from damage caused by the pallet jacks or fork lift tines.

These and other advantages will be readily apparent to those skilled in the art with reference to the description and drawings presented herewith.

DESCRIPTION OF THE PREFERRED EMBODIMENT

Figure 1:
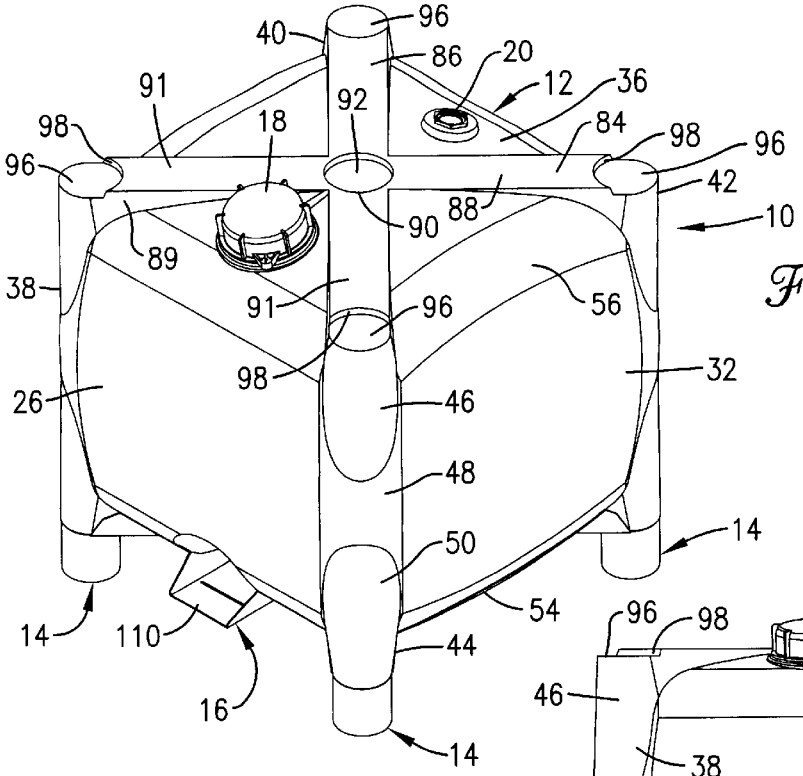
FIG. 1 is a right upper front perspective view of the fluid tank assembly of the present invention having a bottom protector attached by legs coupled to the bottom wall of the tank.
Figure 2:
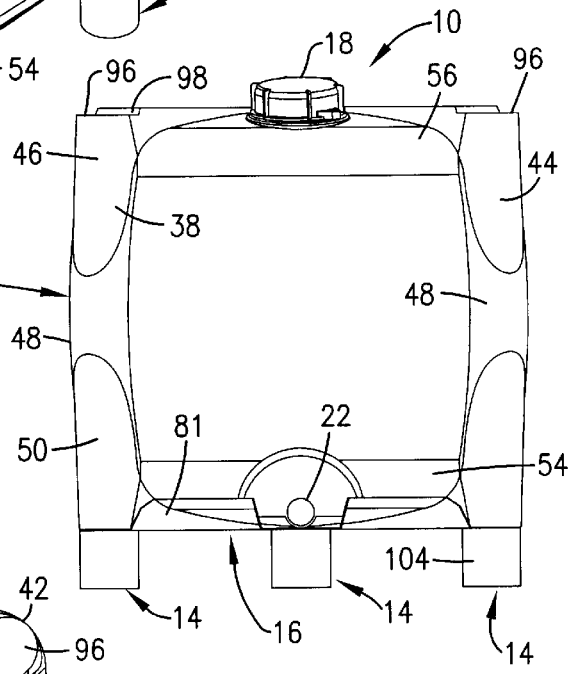
FIG. 2 is a front elevational view thereof, showing the recesses at the tops of the support columns.

Referring now to the drawing, a fluid tank assembly 10 for transportation and storage of liquids and in accordance with the present invention preferably includes a tank 12, a plurality of legs 14 and a bottom protector 16. The tank 12, legs 14 and bottom protector 16 are molded of synthetic resin such as high density polyethylene. The tank 12 is of a capacity in the range of 15 U.S. gallons to 793 U.S. gallons, and may receive thereon a cap 18 and a bung 20 to aid in filling, venting and emptying the tank, as well as an outlet 22 for receiving a discharge pipe shown in phantom which may include a valve or other regulating member. The legs 14 are preferably configured for removable mounting to the tank 12 without the necessity of tools.

In greater detail, the tank 12 has a substantially continuously molded outer wall 24 including sidewalls 26, 28, 30 and 32, a bottom wall 34 and a top wall 36. The sidewalls, bottom wall and top wall a curvilinear but not of a continuous curvature. As shown in the drawings, the tank 12 has a generally polygonal shape as opposed to generally spherical or cylindrical. In the preferred embodiment shown herein, the tank 12 is generally square in horizontal cross-section, although other generally polygonal shapes could be provided. The sidewalls define four corners with support columns 38, 40, 42 and 44 located at the respective corners. The support columns each include a generally frustoconical upper support member 46 which narrows in cross section moving from a bottom to top direction, a transition section 48 of generally cylindrical shape, and a generally frustoconical lower support member 50 which narrows in cross section moving from a top to bottom direction. The tank 12 has a fluid storage chamber 52 within the outer wall 24, and the support columns form a part of the outer wall and thus receive liquid therein.

Figure 3:
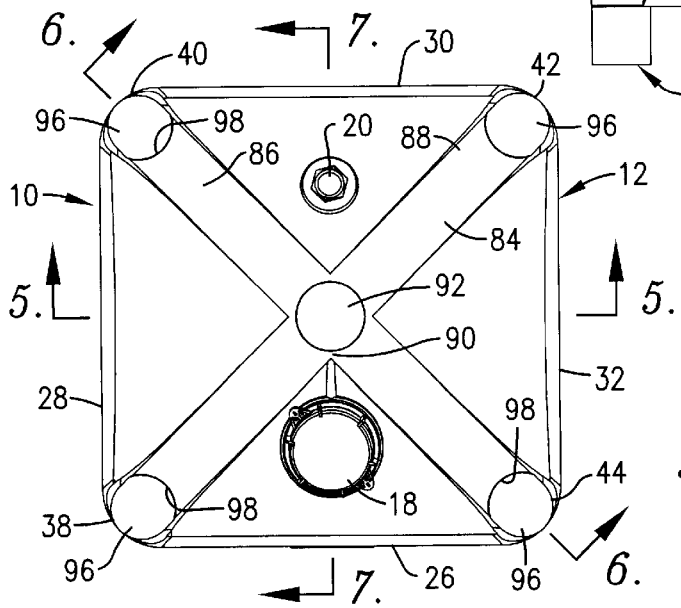
FIG. 3 is a top plan view thereof, showing the center indentation at the intersection of the diagonally extending, generally X-shaped reinforcing channel on the top wall.
Figure 4:
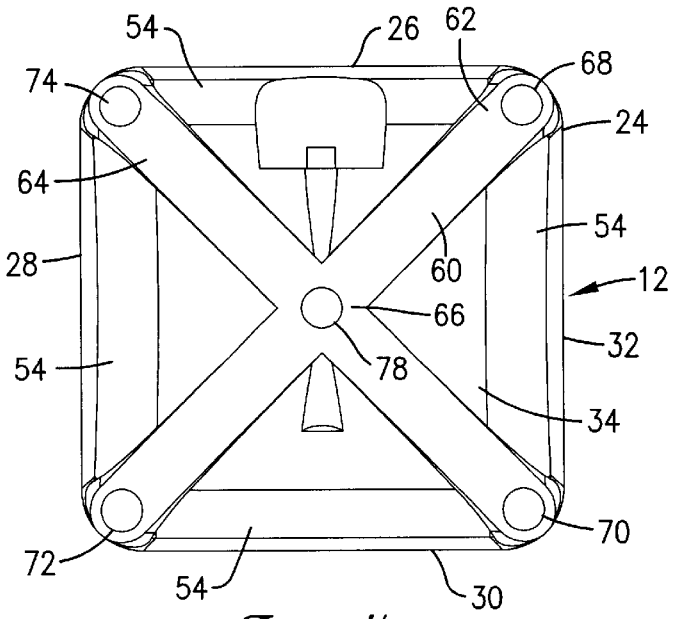
FIG. 4 is a bottom plan view of the tank without the bottom protector or legs attached.

The four sidewalls 26, 28, 30 and 32 are generally curved in the Y axis (in vertical section) as shown by FIG. 4, and may also be curved in the X axis as illustrated by the top plan and bottom views of FIGS. 3 and 4. The sidewalls 26, 28, 30 and 32 merge into the bottom wall 34 along a bottom edge 54 and merge into the top wall 36 along a top edge 56. The bottom edge 54 and top edge 56 are rounded to provide a transition to the sidewalls and to avoid stress concentrations. Thus, the top edge 56, and the bottom edge 54 along sidewalls 28, 30 and 32 and bottom wall 34 which do not include an outlet sump 58, have a radius of curvature preferably of at least 10% of one-half of the distance between the bottom wall and the top wall.

The bottom wall 34 includes an X-shaped reinforcing channel 60 formed therein, the reinforcing channel 60 extending between the support columns as shown in FIG. 4. The reinforcing channel 60 acts as a support beam and cooperates with the adjacent bottom wall areas to transfer loads carried thereby to the sidewalls and support columns acting as a suspension truss. The reinforcing channel 60 presents diagonally extending raised ribs 62 and 64 which are oriented approximately 90° from one another and have an intersection 66. The ribs 62 and 64 extend downwardly relative to adjacent portions of the bottom wall 34. Recesses 68, 70, 72 and 74 are provided in the bottom wall 34 and positioned below each of the support columns 38, 40, 42 and 44, respectively, and have internal threads 76 therein. A central recess 78 is located at the intersection 66 and also has internal threads 76 on a threaded upright sleeve 80, and together with the end wall 82 of the recesses 68, 70, 72, 74 and 78, provide additional reinforcement for the bottom wall 34. The ribs 62 and 64 each include opposed downwardly extending siderails 81 and a bottom deck 83, the decks 83 of each of the ribs 62 and 64 being substantially coplanar to proved even surfaces for lifting of the tank 12 by a fork lift or pallet jack.

Figure 5:
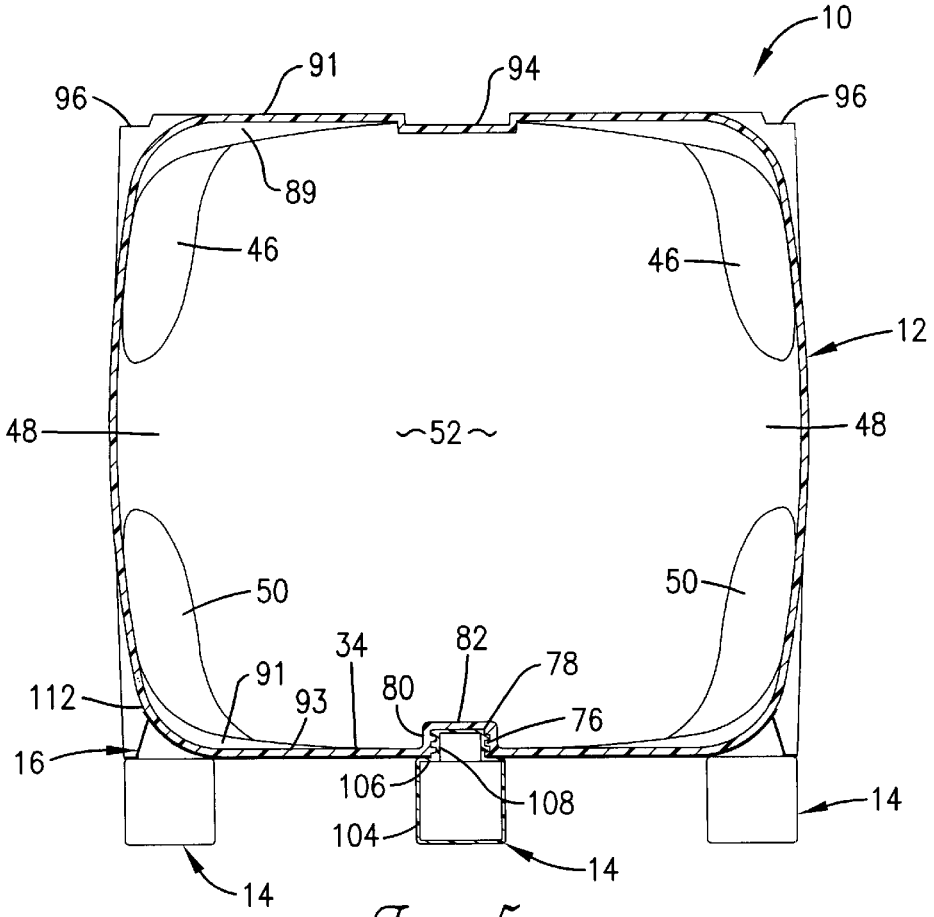
FIG. 5 is a vertical cross-sectional view taken along line 5—5 of FIG. 3, showing the arcuate side walls and rounded corners of the tank.
Figure 8:
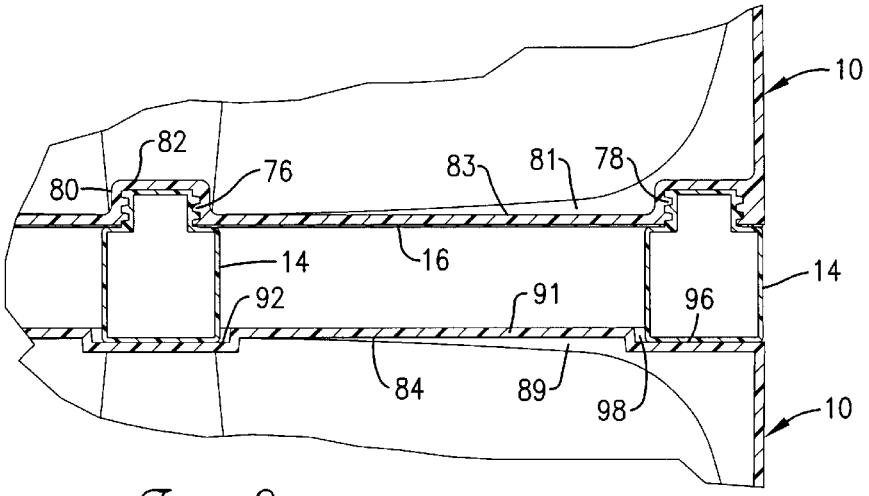
FIG. 8 is an enlarged fragmentary vertical sectional view showing the positioning of the legs when two tank assemblies are in superposed, stacked relationship.

The top wall 36 also includes an X-shaped reinforcing channel 84 which includes raised ribs 86 and 88 having an intersection 90, the ribs 86 and 88 being in substantial vertical alignment with the ribs 62 and 64 and having side rails 89 and a top deck 91. An indentation 92 relative to the top deck 91 is provided at the intersection 90, which has a reception surface 94 which is substantially co-planar with reception surfaces 96 of the reinforcing channel which are vertically aligned with and atop the support columns as shown in FIG. 5. The reception surfaces 96 at the ends of the ribs 86 and 88 each have an arcuate margin 98 on the inboard area toward the intersection 90 which aid in locating the legs 14 of a similar fluid tank 10 assembly thereon as shown in FIG. 8. The top wall also includes a threaded collar 100 for receiving the cap 18 and an internally threaded neck 102 for threadably mounting the two-part removable bung 20.

Figure 6:
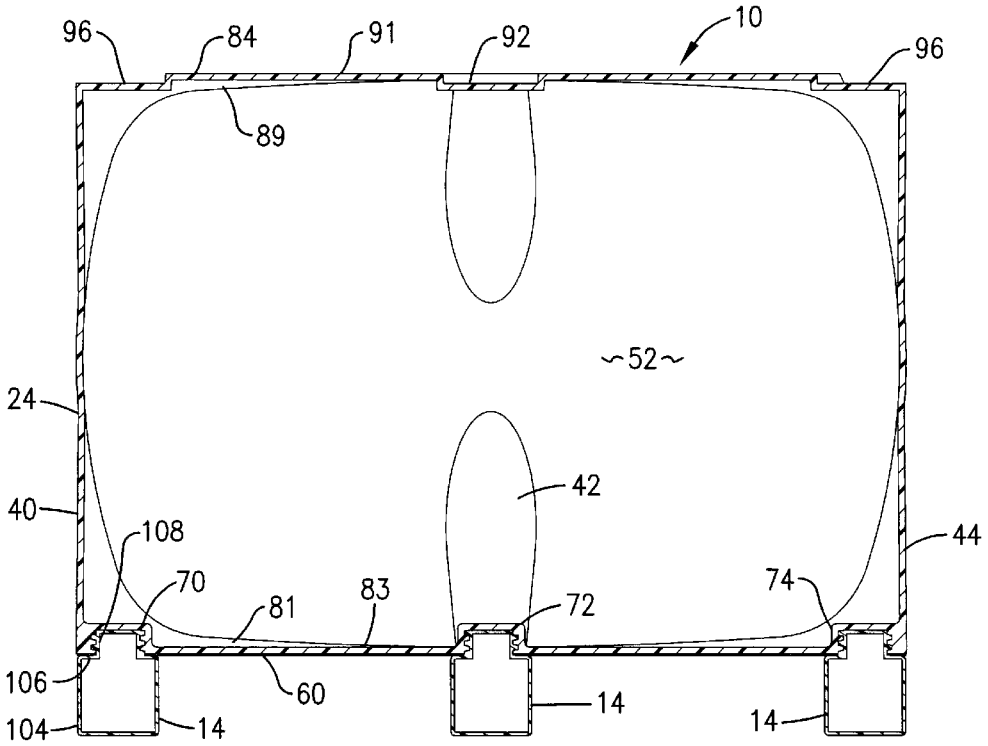
FIG. 6 is a vertical cross-sectional view taken along line 6—6 of FIG. 3, showing the threaded attachment between the legs and the recesses in the bottom wall and the transition between the side wall and the support column.
Figure 7:
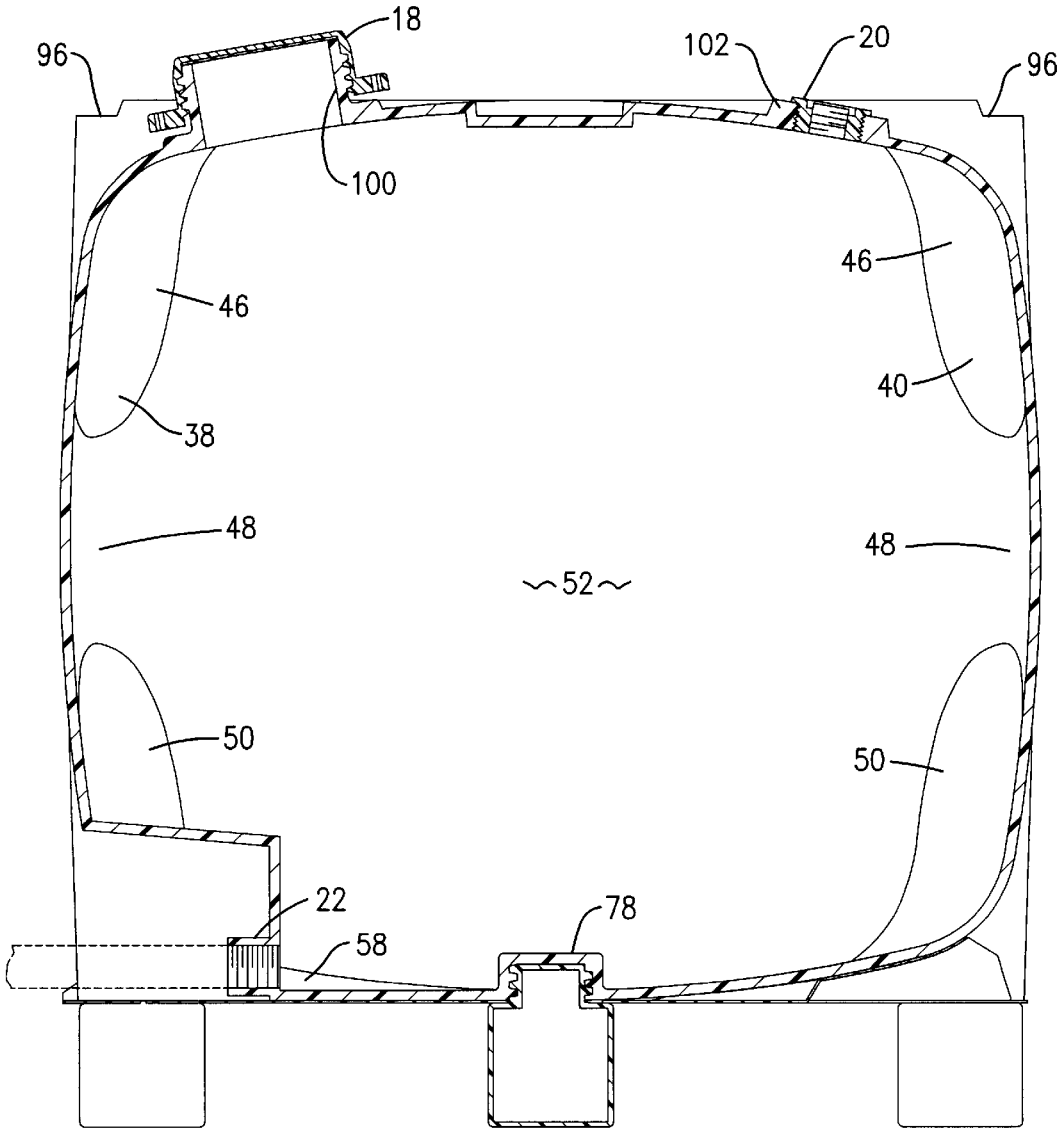
FIG. 7 is a vertical cross-sectional view taken along line 7—7 of FIG. 3 showing the arcuate side walls and showing a discharge pipe in phantom.

The support columns 38, 40, 42 and 44 are substantially vertical when the tank assembly 10 is in normal use. While the upper support member 46 and the lower support member 50 extend from the sidewalls, the transition area 48 blends into the sidewalls without sharp corners or curvatures. For example, while the sidewalls 28 and 30 are oriented at substantially right angles to one another, the transition area 48 of the support column 38 positioned at the intersection between the adjacent sidewalls 28 and 30 is arcuate in horizontal section, having a radius of curvature of at least about 5% of the distance between sidewalls 28 and 32, and also sidewalls 30 and 34. The transition area substantially blends and merges into the sidewalls 28 and 30 as it turns the corner so that no appreciable edge is noticeable between the transition area 48 and the sidewalls 28 and 30. Thus, as seen in FIGS. 5, 6 and 7 looking at the inner surface of the sidewalls and support columns which is substantially smooth and continuous therebetween, the effect is to provide an outer wall 24 which is substantially smooth and continuous without edges at least in the area of the transition areas 48 located substantially midway between the top wall and the bottom wall, but alternatively could include planar wall segments as a part thereof. The curvilinear walls serves to avoid stress concentrations in the tank 12 and makes it more capable of supporting loads placed thereon. It may be appreciated that the cross-sectional view shown in FIG. 6 would be substantially the same if the section were taken along a plane rotated 90° counterclockwise as seen in FIG. 3.

The legs 14 are commonly configured with one another, each having a base 104 extending upwardly to a shoulder 106 and a threaded shank 108 complementally sized to thread into the recesses of the bottom wall 34. The legs 14 are of sufficient height to permit a forklift or pallet jack to be inserted below the bottom wall 34. The base 104 is preferably substantially cylindrical so as to be symmetrical, thereby permitting tolerance in manufacturing regarding the orientation of the threads, and is of a transverse dimension complemental to be received in the indentation 92 and to fit atop the reception surfaces 96 of the reinforcing channel 84 atop the support columns. Thus, the base 104 preferably has an outer radius which is complemental with the curvature of the arcuate margins 98.

The bottom protector 16 is preferably molded as a sheet or web which substantially conforms in contour to the bottom wall 34 of the tank 12. It includes a front pan 110 providing access to the outlet pipe or discharge valve, and deflectors 112 around the edge. The bottom protector further includes holes 114 therethrough which are positioned in registry with the recesses of the bottom wall 34. The holes 114 are of a diameter to permit the threaded shanks 108 of the legs 14 to pass therethrough and into the recesses, but to engage the shoulders of the legs 14 so that the bottom protector is thereby held in place.

In use, the tank 12 may be readily tipped to one side because of its light weight, and the outlet pipe or valve installed in the outlet 22. The bung 20 may be installed in the top wall 36, and the bottom protector 16 positioned on the bottom wall 34 so that the legs 14 may be threaded into the recesses to thereby hold the bottom protector in place. This completes the tank assembly 10, which is then ready to be filled through the collar and the cap 18 threaded thereon. The tank assembly 10 may also be lifted onto another tank assembly 10 as shown in FIG. 8. In this stacked arrangement, the bases 104 of the legs 14 are received on the reception surfaces 96 atop the support columns, with the leg positioned in the central recess 78 located in the indentation 92 as shown in FIG. 8. It may be appreciated from FIG. 8 that ample clearance is still provided between the legs 14 and between the bottom wall 34 of the upper tank assembly 10 and the top wall 36 of the lower tank assembly 10 that the tines of a forklift may be easily inserted therebetween to permit lifting and removal of the upper tank assembly 10. The engagement of the legs 14 with the top wall 36 around the indentation and the arcuate margin 98 inhibit relative lateral movement between the upper tank assembly 10 and the lower tank assembly 10 as illustrated in FIG. 8. The weight of the tank assemblies is evenly transferred to the legs 14, thus inhibiting collapse and leakage of the contents of the tanks 12.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention. For example, externally threaded extensions could be molded into and extend from the bottom wall with the legs having internal threads for receipt thereon. The support columns may be substantially cylindrical instead of frustoconical. Further, the tank could be configured with an outer wall of a variety of shapes, including a substantially continuously arcuate shape such as a sphere with three, four or more support columns molded into the perimeter for support. Additional threaded recesses could be provided to permit additional legs to be mounted, or the leg 14 located in the central recess 78 could be eliminated.

The inventor hereby states his intent to rely on the Doctrine of Equivalents to determine and assess the reasonably fair scope of his invention as pertains to any apparatus not materially departing from but outside the literal scope of the invention as set out in the following claims.

What is claimed is:

1. A fluid tank assembly comprising:

a tank molded of synthetic resin and defining therein a fluid storage chamber, said tank including a plurality of sidewalls, a top wall and a bottom wall, said bottom wall including attachment structure; and a plurality of discrete legs complementally configured for removable coupling to said attachment structure in supporting relationship to said tank, said attachment structure including a plurality of internally threaded recesses molded into said bottom wall, said legs each comprising a threaded, synthetic resin shank configured for threaded coupling to a respective one of said recesses, such that each leg is rotated relative to the attachment structure when coupled or decoupled thereto.

2. A fluid tank assembly as set forth in claim 1, wherein said tank includes a plurality of support columns positioned in spaced relationship between said side walls, and wherein at least some of said recesses are located below said support columns.

3. A fluid tank assembly as set forth in claim 2, wherein said bottom wall includes at least one recess positioned relatively inboard of said sidewalls.

4. A fluid tank assembly as set forth in claim 3, wherein said top wall includes at least one indentation configured to receive a leg of a second fluid storage tank assembly stacked thereon.

5. A fluid tank assembly comprising:

a fluid storage tank having a fluid storage chamber therein, said tank including:

a plurality of sidewalls, with adjacent sidewalls oriented in generally angular relationship to one another;

a bottom wall integrally molded with said sidewalls and connected thereto along a curved bottom edge;

a top wall integrally molded with said sidewalls and connected thereto along a curved top edge; and a plurality of normally upright support columns integrally molded with said sidewalls and located at corners between adjacent sidewalls, said support columns including a lower support member extending generally downwardly and including an internally threaded recess, said support columns each projecting upwardly beyond the top edge and downwardly beyond the bottom edge, said support columns, said sidewalls, said top wall and said bottom wall defining the fluid storage chamber therein.

6. A fluid tank assembly as set forth in claims 5, wherein said support columns include an upper support member having a top configured for receiving another tank assembly thereon and a transition area which substantially merges into said sidewalls to provide a substantially smooth and continuous surface between adjacent sidewalls.

7. A fluid tank assembly as set forth in claim 6, wherein said upper support member is substantially frustoconical.

8. A fluid tank assembly as set forth in claim 6, wherein said lower support member extends generally downwardly opposite the upper support member.

9. A fluid tank assembly as set forth in claim 8, wherein said lower support members are substantially frustoconical.

10. A fluid tank assembly as set forth in claim 5, including a leg threadably received in the recesses of said lower support members.

11. A fluid tank assembly as set forth in claim 5, wherein said bottom wall includes a reinforcing channel extending between diagonally opposed support columns.

12. A fluid tank assembly as set forth in claim 5, wherein the capacity of said fluid storage tank is at least about 15 gallons.

13. A fluid tank assembly as set forth in claim 5, wherein said bottom edge and said top edge are arcuate each having a radius of curvature of at least 10% of one-half the distance between said top wall and said bottom wall.

14. A fluid tank assembly comprising:

a fluid storage tank having a fluid storage chamber therein, said tank including:

a plurality of sidewalls, with adjacent sidewalls oriented in generally angular relationship to one another;

a bottom wall integrally molded with said sidewalls and connected thereto along a curved bottom edge, said bottom wall including a reinforcing channel;

a top wall integrally molded with said sidewalls and connected thereto along a curved top edge; and a plurality of normally upright support columns integrally molded with said sidewalls and located at corners between adjacent sidewalls, said reinforcing channel extending between diagonally opposed support columns, said support columns each projecting upwardly beyond the top edge and downwardly beyond the bottom edge, said support columns, said sidewalls, said top wall and said bottom wall defining the fluid storage chamber therein, wherein said reinforcing channel in the bottom wall has an intersection, and wherein said bottom wall includes a threaded recess at said intersection and each of said support columns includes a downwardly oriented threaded recess, and including a plurality of legs having threaded shanks received in said threaded recesses.

15. A fluid tank assembly as set forth in claim 14, including a bottom protector having a plurality of holes, said bottom protector being coupled to said tank by passing said threaded shanks through said holes and threading said shanks into said recesses.

16. A fluid tank assembly as set forth in claim 14, wherein each of said threaded recesses is integrally molded into said tank.

17. A fluid tank assembly as set forth in claim 16, wherein said top wall includes a reinforcing channel extending between diagonally opposed support columns and having a top deck, said reinforcing channel presenting a plurality of reception surfaces generally atop said support columns and which are positioned in a substantially horizontal plane recessed below said top deck of said reinforcing channel.

18. A fluid tank assembly as set forth in claim 17, wherein said reinforcing channel in said top wall has an intersection including an indentation sized to receive one of said legs therein.

19. A fluid tank having a chamber for receiving liquid therein, said tank comprising:

a generally polygonal structure in horizontal cross-section and having a plurality of upright corner support sections in fluid communication with the chamber;

said structure having a top wall, a plurality of upright side walls extending between adjacent ones of said corner sections, and a curvilinear bottom wall merging into each of said side walls along a bottom edge thereof, said corner support sections each projecting downwardly beyond the bottom edges of adjacent ones of the side walls; and bottom structure integrally joined to said bottom wall in complemental supporting relationship thereto, said bottom structure including a plurality of raised ribs, each of which projects generally vertically from adjacent portions of the bottom wall and extends between respective diametrically opposed ones of said corner sections.

20. A fluid tank as set forth in claim 19, said bottom structure including a plurality of recesses therein and including a plurality of support legs complementally configured for mating engagement with said recesses for elevating the bottom wall above a support surface and providing a fluid tank assembly.

21. A fluid tank assembly as set forth in claim 20, wherein at least some of said recesses are positioned in vertical alignment with at least some of said upright corner support sections.

22. A fluid tank assembly as set forth in claim 21, wherein said bottom structure presents an intersection and including a recess located at said intersection configured for receiving one of said support legs.

23. A fluid tank assembly as set forth in claim 20, wherein said recesses and support legs include complemental coupling structure for coupling the support legs to the bottom structure.

24. A fluid tank assembly as set forth in claim 23, including a web having at least one of hole therein, and wherein at least one of said support legs partially passes through said hole and couples said web adjacent the bottom wall.

25. A fluid tank assembly as set forth in claim 20, wherein said top wall includes reception surfaces complementally configured to receive thereon the support legs of a second fluid tank stacked thereon.

26. A fluid tank assembly as set forth in claim 25 and further including a reinforcing channel integrally joined to said top wall and extending between respective diametrically opposed ones of said corner sections.

27. A fluid tank as set forth in claim 19, wherein said plurality of ribs comprises first and second ribs in angular relationship, each of said ribs having downwardly extending siderails and a deck, and wherein the deck of each of said ribs is substantially coplanar.

28. A fluid tank as set forth in claim 27, wherein said ribs are oriented in substantially perpendicular relationship.

* * * * *